United States Patent [19]

Weaver

[11] 4,290,730

[45] Sep. 22, 1981

[54] ATTACHMENT FOR FORK LIFT

[75] Inventor: James A. Weaver, Topeka, Kans.

[73] Assignee: General Foods Corporation, White Plains, N.Y.

[21] Appl. No.: 129,914

[22] Filed: Mar. 13, 1980

[51] Int. Cl.[3] ..... E05F 13/02; B66F 9/19

[52] U.S. Cl. ..... 414/607; 414/373; 105/462

[58] Field of Search ..... 105/378, 462; 414/373, 414/572, 607, 608, 684.3; 212/166; 49/276, 262; 254/133 R

[56] References Cited

U.S. PATENT DOCUMENTS 4,149,644 4/1979 Fuller ..... 414/607

4,160,509 7/1979 Switzer ..... 414/607

*Primary Examiner*—Trygve M. Blix

*Assistant Examiner*—Terrance L. Siemens

*Attorney, Agent, or Firm*—Mitchell E. Alter; Daniel J. Donovan; Thomas R. Savoie

[57] ABSTRACT

An attachment for a fork lift truck for opening and closing sliding doors such as railway freight car doors. The attachment includes a floor that can be engaged by the tines of the fork lift and two vertically spaced apart door engaging members mounted to the floor for transverse movement with respect thereto. The floor also mounts an upstanding cage assembly so that a person can work inside a protected area.

7 Claims, 5 Drawing Figures

ATTACHMENT FOR FORK LIFT

DESCRIPTION

1. Technical Field

The present invention relates to a device usable with a fork lift truck for opening and closing sliding doors; and in particular relates to an attachment mountable on the tines of a fork lift truck for safely opening and closing a railway freight car door. In a specific embodiment, the present invention also provides an enclosed cage mounted on the door operator attachment for protecting workers while they inspect a freight car.

2. Background Art

The use of fork lift trucks to accomplish tasks other than just lifting is well established in the industry. Among these tasks is the operation of freight car doors and the lifting of personnel so that freight cars can be inspected. The Occupational Safety and Health Administration (OSHA) has even published Rules and Regulations regarding the use of fork lift trucks in these areas (39 Fed Register 23696, June 27, 1974).

Most railroad car doors are designed to be opened manually. These doors include an interior bulkhead door and an exterior box car "plug" type door. However, because of the typically large door size, heavy weight, and the door track design, unassisted manual opening and closing of the doors is often very difficult. In addition, the operation of the doors can be very dangerous. The doors frequently escape the upper door track and fall off, often injuring or, on at least one occasion, killing operating personnel.

In addition, it is often necessary and always desirable to be able to safely inspect the upper door track. This track is about 10 feet above the car floor and is quite long. Pursuant to OSHA regulations, precautions for the protection of personnel must be provided if the fork lift truck is to be used to elevate the personnel. These precautions include the use of a safety platform firmly secured to the lifting forks, means on the platform to enable personnel to shut off power to the fork lift truck, and means for protecting the personnel from falling objects.

There are several known attachments for fork lift trucks that will satisfy a further OSHA requirement that the power equipment supplies closing or opening force to the door in a direction parallel to the door travel. One such device is comprised of a single, fixed member horizontally mounted transverse to two parallel, spaced apart sleeves that are adapted to receive the tines of the fork lift. The distal end of the fixed member is adapted to engage the car push pockets on some car doors or to accommodate a chain and hook that in turn is attachable to the car door. The hook and chain feature is also disclosed in the freight car door opener depicted in the Switzer U.S. Pat. No. 4,160,509. Another fork lift truck attachment for opening and closing railway freight car doors is depicted in the Fuller U.S. Pat. No. 4,149,644.

However, none of the aforementioned devices addresses the problem of freight car doors falling off or provides a means for operating a freight car door so as to minimize the door's escaping the upper track or falling off. Furthermore, none of these devices are adjustable so that they can be used at different horizontal distances between the platform and the freight car door.

DISCLOSURE OF INVENTION

Accordingly, the present invention overcomes these and other disadvantages. An essential feature of the present invention is the provision of a means for safely, practically, efficiently, and economically opening and closing a freight car door so as to minimize the possibility of the car door escaping the upper track and falling off. Should the door still fall off, it is a purpose of the present invention to safely retain the door in an upright position. It is also a feature of the present invention to provide an attachment for easy and fast removable mounting on a fork lift truck. Another feature is to provide a device that can open or close massive sliding doors such as freight car doors with a minimum amount of damage to the door and the door tracks and yet is still operable by a single employee without the necessity of dismounting the lift truck.

A further feature of one embodiment of the present invention is to provide a protected access platform for elevated inspections of the freight car and the upper car door track, and to permit a person to safely and easily seal the upper edges of a freight car plug-type door.

The present invention, in one embodiment thereof, comprises two, vertically spaced apart door engaging members separated a distance apart such that the upper member can engage a region of a sliding door a substantial distance above the region of the sliding door engaged by the lower member; and a horzontal support member for supporting the door engaging members and having receiving means for receiving the tines of a fork lift truck such that the support member is carried in a substantially horizontal plane on the fork lift truck.

By providing two vertically spaced apart door engaging members, the present invention spreads the pushing force more evenly over the face of the freight car door, minimizing any canting of the door, and minimizing any malfunctioning of the door during the opening or closing thereof. The present invention also minimizes damage to the door and the door track while simultaneously affording more protection to operating personnel.

In a further emobdiment of the present invention, a cage is provided for the platform so as to allow a safer and more convenient inspection of the door tracks and the freight car.

In another embodiment of the present invention, means are provided for laterally moving the door engaging members relative to the fork lift truck. In this embodiment, the door engaging means are adjustable so that the present invention can be used to open the freight car doors and can be used at different horizontal distances between the platform and the freight car door.

Other details, features, and objects of the present invention will be set forth in, or apparent from the accompanying drawings and detailed description of the preferred embodiments found hereinbelow.

BEST MODE FOR CARRYING OUT THE INVENTION

Figure 1:
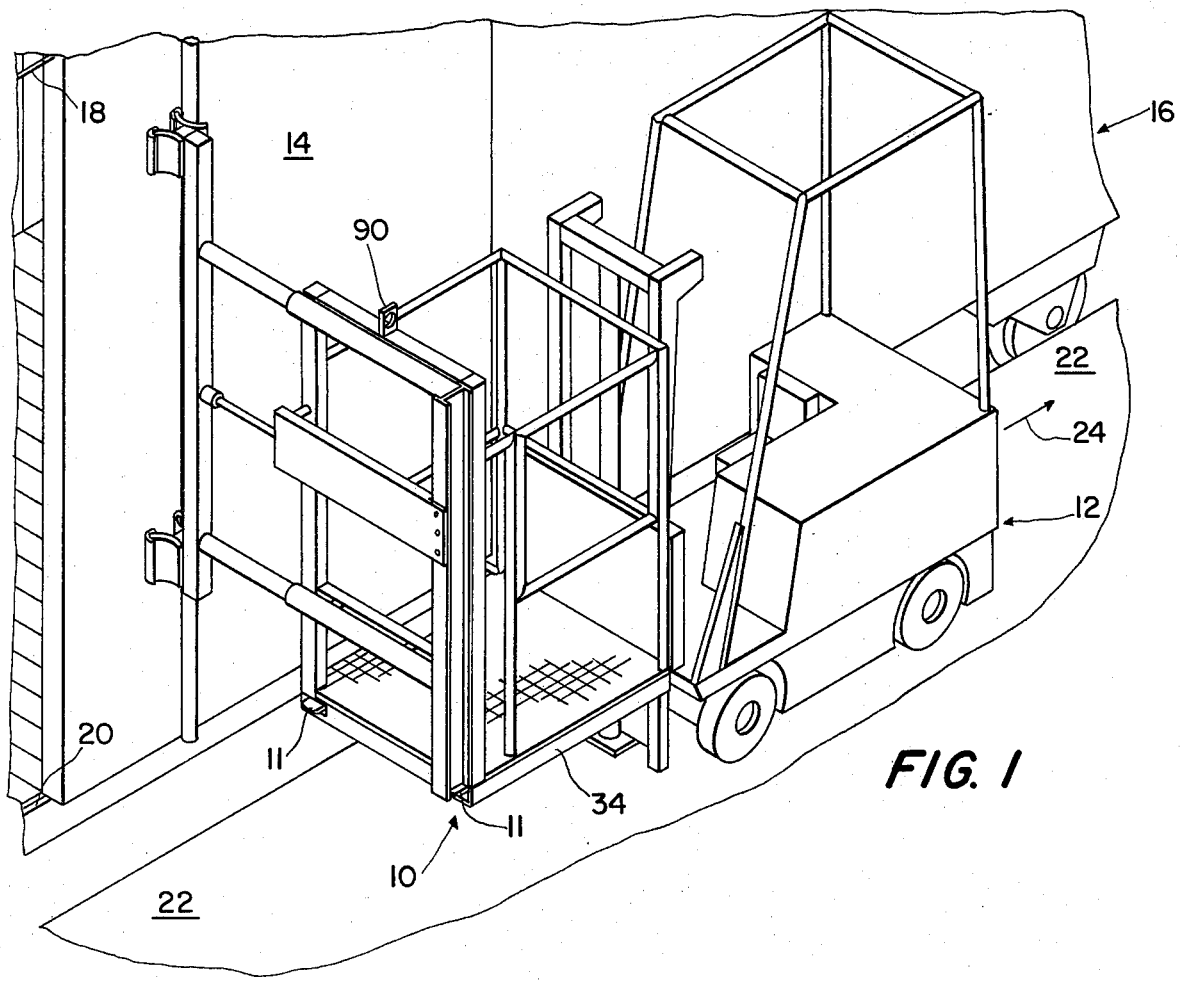
FIG. 1 is a perspective view of an embodiment of the invention depicted in an operative position in engagement with a freight car door.

With reference now to the drawings wherein like numerals represent like elements throughout the several views, and in particular with reference to FIG. 1, a fork lift attachment 10 according to the present invention is depicted mounted on the tines 11 of a fork lift truck 12 and engaging an exterior "plug" type sliding door 14 of a conventional freight car 16. Freight car door 14 is mounted on and rides along an upper track and a lower track generally shown at 18 and 20, respectively. A platform 22, transversely spaced horizontally from freight car 16, provides a supporting surface for fork lift truck 12. As can be seen in FIG. 1, freight car door 14 is opened as fork lift truck 12 is moved in a longitudinal direction shown by arrow 24 that is parallel to freight car 16.

Figure 2:
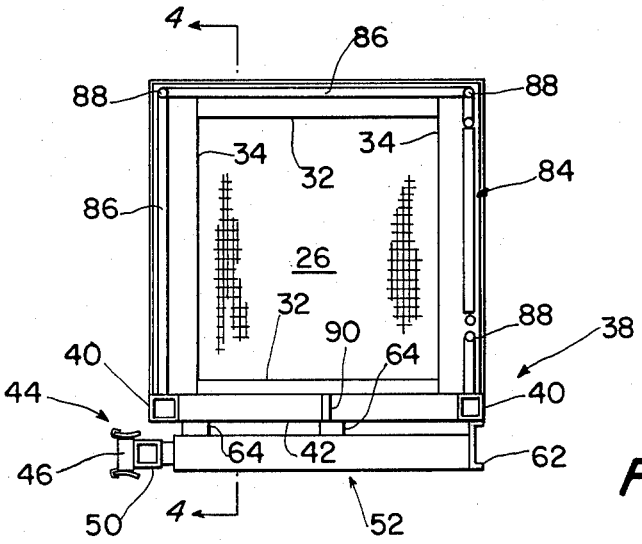
FIG. 2 is a plan view of the embodiment of FIG. 1 taken from a blueprint.
Figure 3:
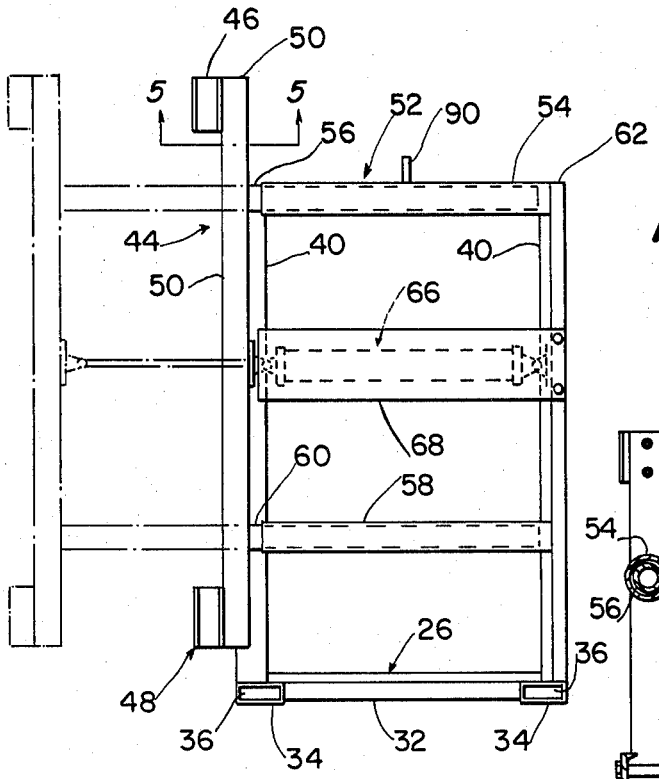
FIG. 3 is a front elevation view of the embodiment of FIG. 1 taken from a blueprint.
Figure 4:
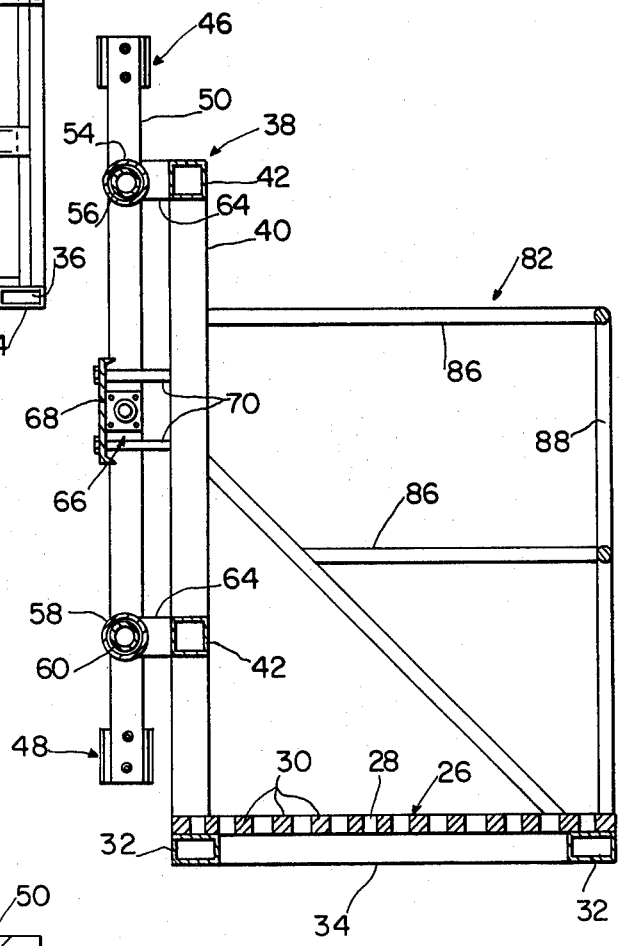
FIG. 4 is a side elevation view in cross-section taken along lines 4—4 of FIG. 2.

As shown in FIGS. 2, 3 and 4 attachment 10 is comprised of an open steel grating floor 26 made up of a plurality of longitudinal bars 28 and a plurality of transverse bars 30 welded together into an integral, horizontal surface (see particularly FIG. 4). Floor 26 is mounted on top of four square structural tubing, two transverse tubing members 32 and two longitudinal tubing members 34, which form a square, annular foundation. Longitudinal tubing members 34 are preferably open at each end and have an interior bore 36 that is large enough to receive the corresponding tine of fork lift truck 12.

Mounted to the forward end of floor 26 is a vertical frame 38 preferably comprised of two vertical, square structural tubing posts 40 and two horizontal, square structural tubing rails 42. Frame 38, in turn, supports a door engaging assembly 44 comprised of an upper and lower door engaging member 46 and 48, respectively, mounted at either end of a vertical post 50, and a telescopic mounting assembly 52 for mounting post 50 so as to provide lateral movement thereof between a withdrawn position (shown in solid FIG. 2) and an extended, door engaging position (shown in phantom in FIG. 3). The vertical spacing between upper and lower door engaging members 46 and 48 is a substantial distance so that the corresponding regions of freight car door 14 engaged thereby are a substantial distance apart. An exemplary distance would be approximately five feet.

Telescopic mounting assembly 52 includes an upper outer and telescoping inner cylinders 54 and 56 and a lower outer and telescoping inner cylinders 58 and 60. As seen in FIGS. 2 and 3, the right-end of both outer cylinders 54 and 58 is rigidly mounted to the base of a C-channel 62 even with the outer edge thereof, while the inner edge thereof is, in turn, rigidly mounted to the right-hand frame tubing post 40. Four cylinder supports 64 rigidly mount the central portions and the left-hand portions of outer cylinders 54 and 58 to the two frame tubing rails 42. One edge of each of the inner cylinders 56 and 60 is slidably received inside the corresponding outer cylinder 54 and 58, respectively, while the other end is rigidly mounted to vertical post 50.

Telescopic mounting assembly 52 further comprises a hydraulic piston and cylinder assembly 66, one end of which is pivotally mounted to C-channel 62 and the other end of which is pivotally mounted to vertical post 50. Hydraulic piston and cylinder assembly 66 is also rigidly mounted to a mounting plate 68 which in turn is mounted to frame tubing posts 40 with guard rods 70 (see FIG. 4) and to the outer side of C-channel 62 (see FIG. 3). The hydraulic lines (not shown) are attachable in a conventional manner to the hydraulic system of fork lift truck 12.

Figure 5:
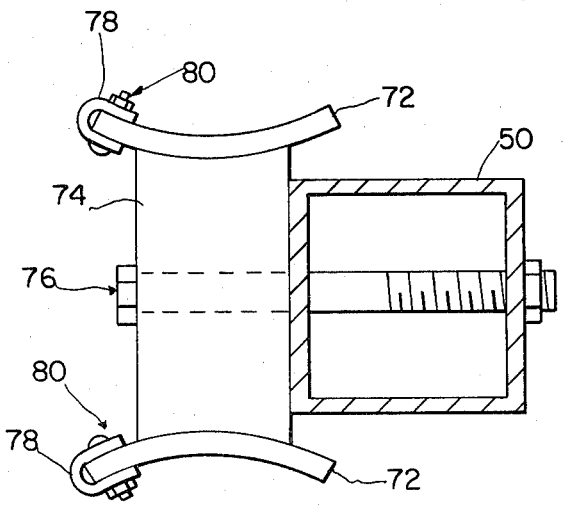
FIG. 5 is a plan view in cross-section taken along lines 5—5 of FIG. 3.

Both upper and lower door engaging members 46 and 48 are similar and will be described with reference to FIG. 5. Each door engaging assembly is comprised of two arcuate channel members 72 that are substantially cup-shaped in horizontal cross-section. Members 72 are respectively mounted at their concave sides to the ends of a square channel member 74 such that the channel openings are respectively oriented in the forward and rearward sense with respect to motion of fork lift truck 12. Square channel member 74, in turn, is bolted to vertical post 50 with a bolt and nut assembly 76. Two resilient edge guards 78, which can be of neoprene, are mounted with a plurality of nut and bolt assemblies 80 around the outermost edges of arcuate member 72 (i.e., along the left-hand edges as seen in FIG. 5).

In addition to frame 38, a cage assembly 82 is also mounted to floor 26 and extends around the other three sides thereof. Cage assembly 82 includes a gate 84 and a plurality of rails 86 and stanchions 88. Cage assembly 82 together with frame 38 provide a protected enclosed area inside the periphery of floor 26.

In use, as shown in FIG. 1, the tubing members 34 of attachment 10 are engaged by the tines 11 of a fork lift truck 12. The attachment 10 is also connected to the mast of fork lift truck 12 with chains or any other conventional means so as to prevent attachment 10 from slipping off the tines of the fork lift truck 12. In addition, the hydraulic hoses of hydraulic piston and cylinder assembly 66 are connected to the hydraulic system of fork lift truck 12. The fork lift is then raised slightly to lift the attachment 10 the desired height above platform 22 and fork lift truck 12 is driven into a parallel position with freight car 16 and spaced approximately one foot therefrom. The hydraulics are then actuated so as to position door engaging assembly 44 at the door post or door rods of freight car door 14. Fork lift truck 12 is then moved parallel to freight car 16 so that the upper and lower door engaging members 46 and 48 sit behind the freight car door post and push freight car door 14 open.

Once the freight car door is opened, the operator can position another worker, inside cage assembly 82, to the desired height to inspect upper door track 18 or the inside of freight car 16. The freight car doors can be closed in a similar manner.

Fork lift attachment 10 can also be provided with an eye hook 90 (see FIG. 1) so that a chain (not shown) can be attached to open an interior bulkhead door or the exterior door. When a chain is used, door engaging assembly 44 can also be positioned to vertically support the door as it is being opened and to prevent a door from falling should the door escape its tracks.

It should be seen that the present fork lift attachment 10 provides a practical, safe, efficient, convenient and economic accessory for opening freight car doors and for inspecting the freight car. In addition, because of the spaced apart door engaging members 46 and 48 there is a reduced amount of damage when the door is operated. Furthermore, the spaced apart engaging members 46 and 48 apply a door operating force that minimizes the danger of the door becoming derailed, and protects the operator from a falling door should the door still become derailed.

Although the fork lift attachment of the present invention has been described in detail with respect to an exemplary embodiment thereof, it will be understood by those of ordinary skill in the art that variations and modifications may be effected within the scope and spirit of the invention.

What is claimed is:

1. An attachment for a fork lift truck for opening or closing a sliding door comprising:

a horizontal support member, said horizontal support member comprising elongate receiving means for receiving the forks of a fork lift truck such that the horizontal support member is carried in a substantially horizontal plane on the forks of the fork lift truck;

a first door engaging member;

a second door engaging member; and means for mounting each of said first and second door engaging members on said horizontal support structure for engaging a sliding door such that once engaged the sliding door can be moved by movement of a fork lift truck on which the attachment is carried, said first and second door engaging members being separated in a vertical direction a substantial distance whereby the upper of said door engaging members is adapted to engage a region of a sliding door a substantial distance above a region of the sliding door which is adapted to be engaged by the lower of said door engaging members.

2. An attachment according to claim 1 wherein said mounting means includes moving means for providing lateral movement of said door engaging members between a withdrawn position and an extended, door engaging position, said lateral movement being sideways relative to the length of the fork lift truck and substantially normal to the length of said elongate receiving means.

3. An attachment for a fork lift truck according to claim 2 further comprising a railing upstanding from said horizontal support member and forming therewith a cage which is moveable in a substantially vertical direction with the forks of a fork lift truck on which the attachment is carried, whereby the attachment can be elevated to a position adjacent a sliding door such that a person positioned in said cage has access to the top of an adjacent sliding door.

4. An attachment for a fork lift truck according to claim 2 wherein said mounting means comprises an upstanding support member secured to said horizontal support member, a vertically oriented elongate support member on which said first and second door engaging members are mounted, and a pair of laterally extending moveable support members each of which is fixed at one to said vertically oriented elongate support member and at the other end to said pair upstanding support member.

5. An attachment according to claim 4 wherein said laterally extending moveable support members each comprise telescoping members.

6. An attachment according to claim 2 wherein said moving means comprises a hydraulic cylinder and piston mounted on said horizontal support member.

7. An attachment according to claims 1 or 2 wherein said first and second door engaging member each comprise a door contacting member, said door contacting member comprising a pair of vertically oriented channel members, each of said channel members being substantially cup-shaped in horizontal cross section, the first channel member being mounted with the channel opening oriented forward in the sense of forward motion of a fork lift truck on which the attachment is carried, and the second channel member being mounted with the channel opening oriented rearwardly in the sense of rearward motion of the fork lift truck.

* * * * *